US005333338A

United States Patent [19]

Anastase et al.

[11] Patent Number: 5,333,338

[45] Date of Patent: Aug. 2, 1994

[54] PROCESS FOR TREATING TEXTILES

[75] Inventors: Constantin Anastase; Jay H. Daily; William C. Nehren, all of Wichita Falls, Tex.

[73] Assignee: White Consolidated Industries, Inc., Cleveland, Ohio

[21] Appl. No.: 104,490

[22] Filed: Aug. 9, 1993

Related U.S. Application Data

[62] Division of Ser. No. 943,495, Sep. 11, 1992, Pat. No. 5,272,893.

[51] Int. Cl.[5] ..... D06F 39/04

[52] U.S. Cl. ..... 8/158; 8/159

[58] Field of Search ..... 68/12.22, 16, 58, 12.12, 68/13 R; 8/158, 159

[56] References Cited

U.S. PATENT DOCUMENTS 4,204,339 5/1980 Muller ..... 68/18 C X

FOREIGN PATENT DOCUMENTS 146099 6/1991 Japan ..... 8/158

*Primary Examiner*—Philip R. Coe

*Attorney, Agent, or Firm*—Pearne, Gordon, McCoy & Granger

[57] ABSTRACT

An enzyme bath maintenance system is provided for use in such textile treating fields as stonewashing, laundry, cleaning and dyeing, including the use of enzymes as the active agent, in which the enzymes are utilized within narrowly controlled ranges of pH and temperature. As a means for providing heat for controlling the temperature, a heat exchanger in which the heat source is hot water at a temperature not more than 12° C. higher than that of the desired temperature, is disposed within the apparatus. The heat exchanger and the apparatus as a whole are designed to avoid pockets which allow the enzyme to become entrapped therein. The apparatus further includes automated means for detecting, monitoring and reporting bath parameters such as pH and temperature, with output for manual or automatic control thereof, and means for agitating the enzyme bath to maintain uniform distribution of the enzyme.

8 Claims, 4 Drawing Sheets

PROCESS FOR TREATING TEXTILES

This is a division of application Ser. No. 07/943,495, filed Sep. 11, 1992, and now U.S. Pat. No. 5,272,893.

BACKGROUND OF THE INVENTION

This invention relates generally to the treatment of textile materials, and more particularly, to a novel and improved method and apparatus for the treatment of textile materials in enzyme baths.

PRIOR ART

Enzymes have been developed to produce specialized treatment of textile materials. For example, it is possible with some enzymes, to simulate the effect previously achieved with stonewashing.

In prior stonewashing systems, the textiles are tumbled in a bath containing stones. During the tumbling of the textiles, such as blue denim jeans, the material is given a worn look, and the fabric is greatly softened. The tumbling stones cause damage to the machine carrying out the process, and means must be provided to separate the stone fragments from the textiles at the completion of the operation.

The cellulase enzyme, because it attacks the molecular structure of the textile, can achieve the stonewashed effect without requiring the use of stones and without the damaging effect produced by the stones.

Other enzymes have been developed and will be developed to perform specialized functions for the treatment of textiles. For example, enzymes for laundry purposes can be targeted to attack fatty materials which constitute many stains. Other enzymes may be targeted to attack the proteinaceous materials of stains such as blood. Most enzymes, however, tend to require very close temperature and pH control for effective performance.

For example, the cellulase enzyme used to simulate the stonewashing effect functions with greatest efficiency within a predetermined narrow temperature range, such as 50° C. to 60° C. If the temperature of the bath drops below such range, the rate of operation of the enzyme decreases, or even ceases, requiring substantial additional time to obtain the required result. On the other hand, if the temperature exceeds a temperature limit slightly above such predetermined range, the enzyme becomes denatured and ceases to function.

In the past, it is believed that cellulase enzymes have been used to simulate the stonewashed effect by introducing into a machine a bath containing the enzyme at a temperature within the predetermined narrow temperature range. While the processing of the textiles within such bath continues, the temperature of the bath decreases due to the transfer of heat to the environment. Consequently, the optimum rate of operation of the enzyme does not continue, and the rate of the enzyme's operation deteriorates. Consequently, longer cycle times are required to achieve the desired result.

It has been observed that the pH of a bath or solution has a similar effect on the performance of enzymes contained therein. For example, a cellulase enzyme used in stonewashing, known as an acid cellulase, operates in a bath having an optimum pH of approximately pH=4.8. A pH substantially out of this range, e.g., ±0.5 pH, will have a deleterious effect on stonewashing performance, reducing efficiency by about 20%. As with excessive heat, if the pH of the enzyme bath becomes too low, the enzyme will be denatured, while a pH too high will chemically destroy the enzyme.

In stonewashing applications, the indigo dye used in blue denim material is released into the bath during the stonewashing operation. This dye causes the bath pH to change with time, requiring addition of chemicals to maintain the desired, predetermined pH value. As a further consequence of the change in bath pH due to the released indigo, the indigo may actually backstain, or re-dye the material.

Such limitations as the relatively narrow temperature and pH range limits discussed above have severely limited the utility of employing enzymes in the textile industry by reducing substantially the efficiency of such processes. Such limitations have increased the cost and time required by these processes, and so have thus limited their practicality.

SUMMARY OF THE INVENTION

In accordance with the present invention, a novel and improved method and apparatus are provided for the treatment of textile materials within enzyme baths. In accordance with one important aspect of this invention, the treatment is performed while the temperature of the enzyme bath is maintained within the optimum temperature range. This is accomplished, however, without exceeding the known, predetermined temperature limit, so the enzyme is not denatured. Further, in accordance with this invention, the pH of the bath is maintained within the optimum pH range. It has been established that with the present invention, the cycle time required to obtain the desired stonewashed obtained effect can be reduced by approximately one-half. The results will be consistent and predictable from batch to batch.

The illustrated machine for processing the textile materials includes an outer shell, which forms the container for the bath. The textile material is treated within the bath. Located within the outer shell is a rotating drum in which the textile materials are placed.

A heat exchanger is located within the shell and is operated so as to automatically maintain the predetermined temperature of the bath within very close limits, such as plus or minus 0.5° C. (approximately equal to ±1° F.). The heat exchanger, in the illustrated embodiment, is connected to a source of heat at a temperature which is close to the predetermined temperature range. Further, the heat exchanger is supplied with heat and operated so that the surface temperature of the heat exchanger, which is in contact with the enzyme bath, does not reach the temperature limit above which the enzyme is denatured.

In addition, the machine includes means for accurately establishing the pH of the bath and for automatically maintaining such pH within the desired range.

In addition, in the illustrated embodiment, the shell is constructed to minimize locations where enzymes, having a high specific gravity, might collect. This ensures that the entire enzyme charge is available to perform the required function. In addition, agitator means are provided between the drum and the shell to ensure that the enzymes being used are uniformly distributed throughout the entire bath.

These and other aspects of this invention are illustrated in the accompanying drawings and more fully described in the following specification.

DESCRIPTION OF THE PREFERRED EMBODIMENT

Figure 1:
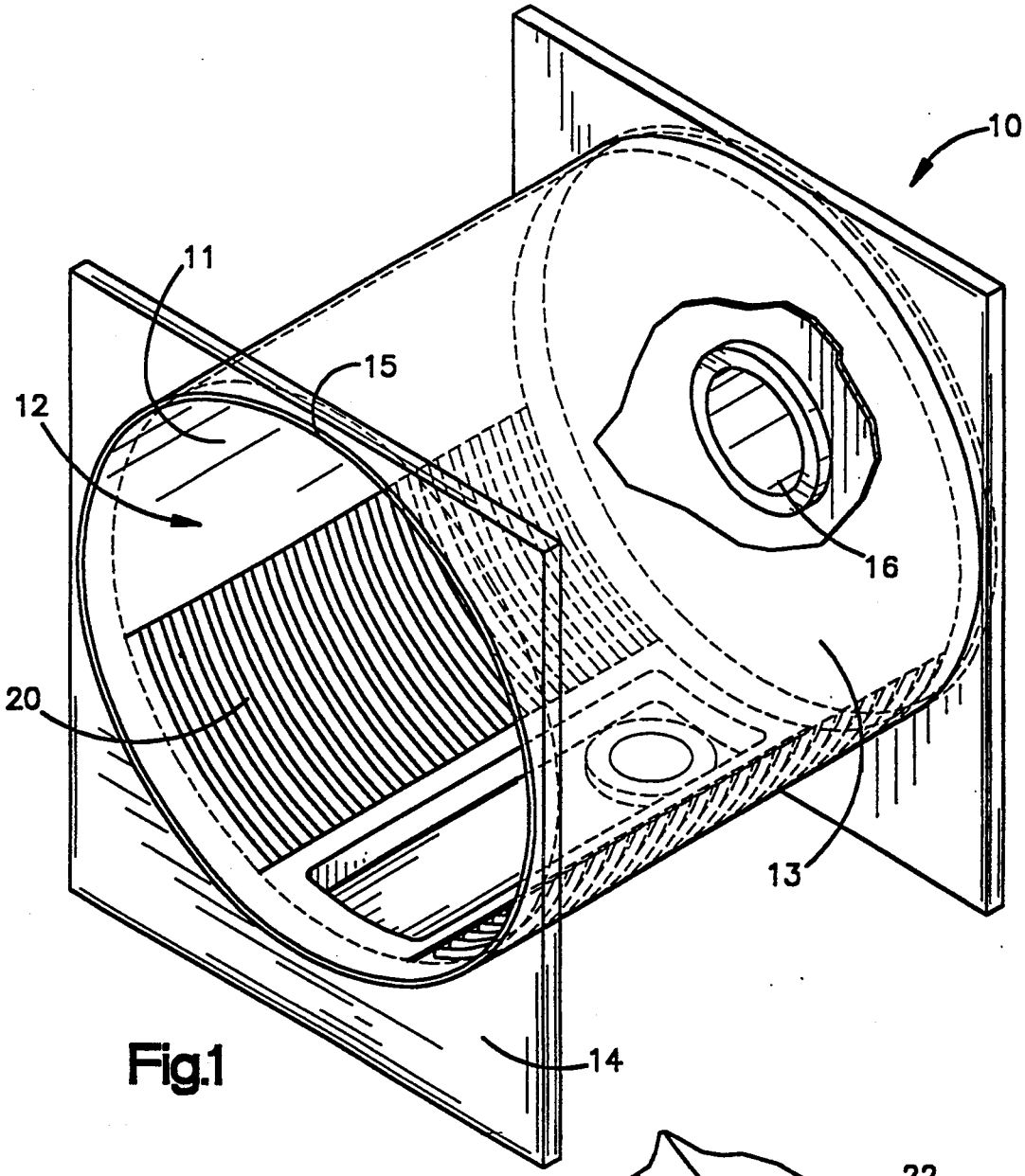
FIG. 1 is a perspective view of the outer cylindrical shell or casing of the textile treating machine.
Figure 2:
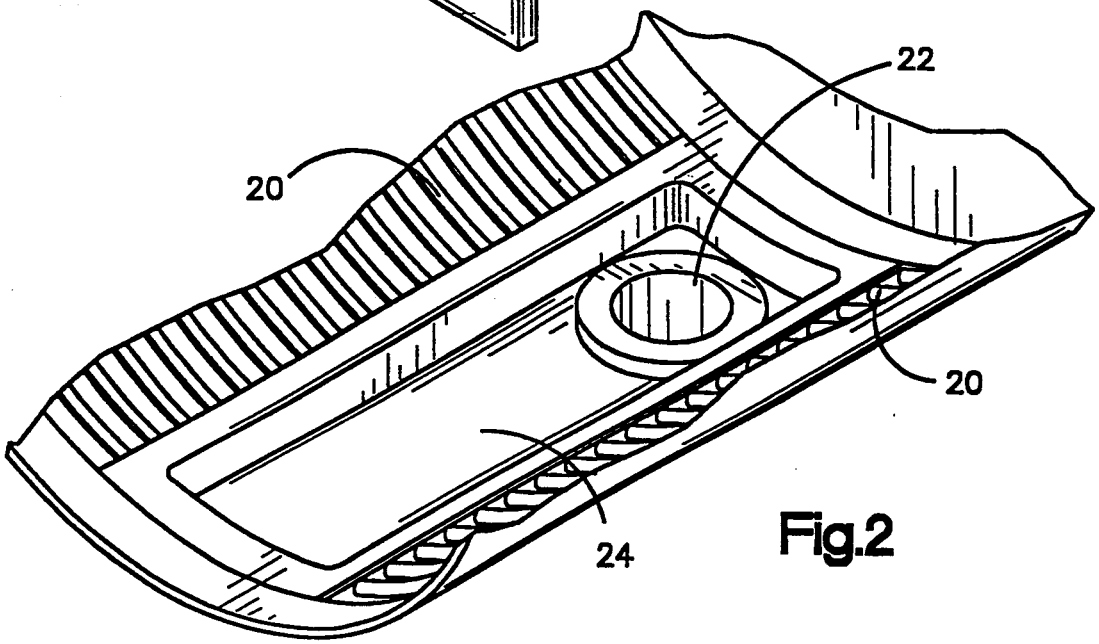
FIG. 2 is a perspective view of an embodiment of the heat exchangers and the sump and drain system.

Referring initially to FIG. 1, the subject textile treating machine 10 includes a stationary, cylindrical shell 12 having a generally horizontal axis adapted to contain a fluid enzyme bath. The shell 12 has a shell inner surface 11 and a shell outer surface 13. The machine is mounted upon standards 14 provided with conventional bearing members 16 and a suitable motor (not shown) for providing driving rotation of cylindrical drum 26 illustrated in FIG. 3. The shell includes heat exchanger elements 20 for providing heat and maintaining the bath temperature to a preselected range and a drain 22 disposed within a slightly recessed sump 24, most clearly shown in FIG. 2. Heat exchanger element constitutes part of the shell inner surface 11. As shown in FIG. 2, the heat exchanger elements 20 are designed to extend along the shell inner surface wall. Both the upper and lower ends of the heat exchanger are open so that portions of the bath behind the heat exchanger cannot become entrapped. The entire shell is structured so as to prevent occurrence of "dead" volume, such as pockets or voids, where enzymes might collect or be entrapped. The heat exchanger 20 may be of the tube or plate type. Further to avoid entrapment of enzymes, the sump 24 is shallow, covering a large area of the shell inner wall as compared to the depth of the sump.

The heat exchanger elements 20 may be either rigidly or removably mounted to the shell inner wall. U.S. patent application Ser. No. 07/954,973, filed Sep. 30, 1992, which is commonly assigned with the present application, is directed towards such removable heat exchanger elements.

Figure 3:
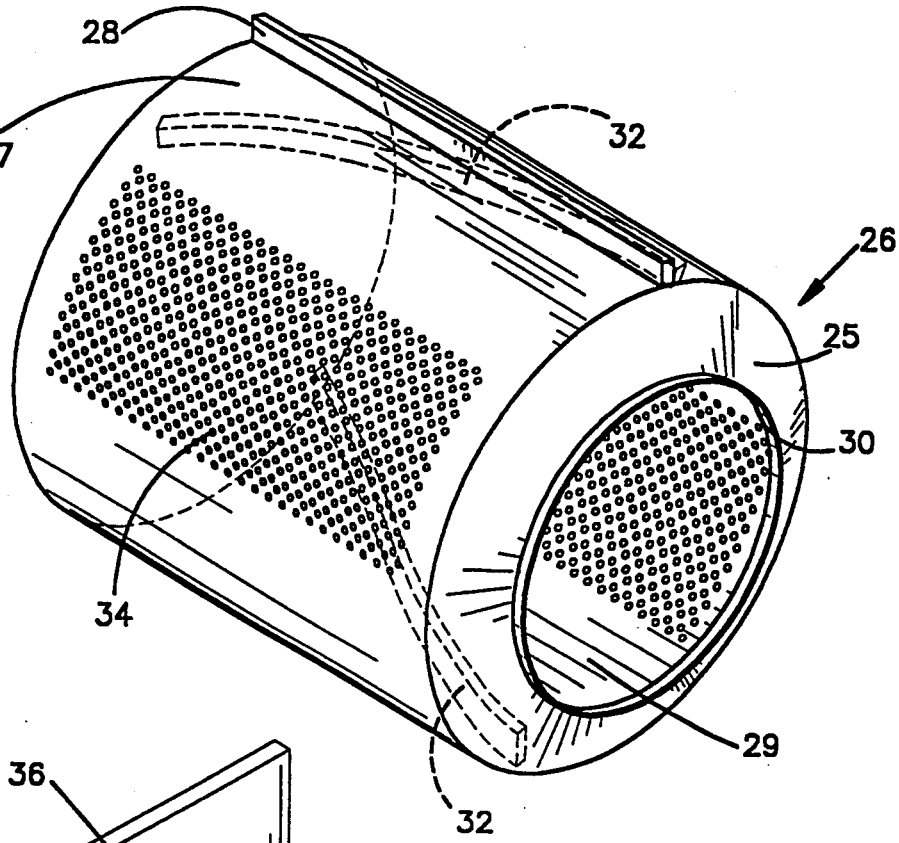
FIG. 3 is a perspective view of the inner cylindrical drum of the textile treating machine.

As shown in more detail in FIG. 3, the apparatus into which the textile materials are placed is a cylindrical drum 26. The drum 26 is horizontally mounted along its axis of rotation, by which the drum is journaled at a first, closed end to bearing members 16 and a second bearing (not shown) for rotation within the outer shell during the processing of textile materials. The rotation provides both continuous mixing and agitation of the bath, and tumbling of the textile materials together with the bath used in the process. A motor (not shown) provides the rotational driving force for this agitation, mixing and tumbling. Continuous mixing and agitation of the bath is preferred, particularly when the enzymes have a high specific gravity and/or when they have limited solubility in the liquid medium employed, which is usually water. Many enzymes do not actually dissolve in water, forming instead a suspension or a colloidal suspension in the bath, which is subject to settling on standing. In such cases continuous agitation insures an even distribution of the enzymes throughout the bath.

Cylindrical drum 26 has a drum outer surface 27 and a drum inner surface 29. As shown in PIG. 3, the drum outer surface 27 is equipped with external, radially outwardly extending vanes or ribs 28 in order to provide the necessary mixing action or agitation of the bath in the zone between the drum 26 and shell 12. The drum inner surface 29 is likewise equipped with internal, radially inwardly extending vanes or breaker ribs 32 for providing agitation of the bath and the textile materials within the interior zone of the drum. The external vanes 28 are sized and mounted to allow only a small clearance between the external vanes 28 and the shell inner surface 11. The cylindrical wall of the drum 26 is penetrated by a plurality of perforations 34 which provide for the bath mixing, agitation, and exchange between the inside and outside zones of the drum. The perforations allow fluid communication between the interior zone of the drum and the zone outside the drum but within the shell, and thereby provide uniform distribution of the enzymes in the fluid or liquid medium of the bath.

The cylindrical drum 26 also includes at a second end a drum access opening 30 at drum end face panel 25 to enable solid materials, including the textile materials to be treated, to be received by the cylindrical drum 26 during processing of textile materials. The drum access opening 30 is disposed axially at the opposite end of the cylindrical drum from the bearing mount at bearing member 16 at the closed end of the cylindrical drum. When the inner, cylindrical drum 26 is operably mounted within the cylindrical shell 12, the drum access opening 30 aligns with the main access opening 60, (FIG. 5).

Any suitable enzyme bath or other liquid additive used for processing the textile materials may be added by suitable means such as inflow pipes 36. The flow into the shell from such inflow means may be disposed either above or below the expected liquid level within the drum. Preferably shell 12 includes both such inflow means, since some agents are better added below the water line and others are preferably added above the water line. The bath is combined with the textile materials to be treated by the mixing and agitating action of the drum.

Figure 4:
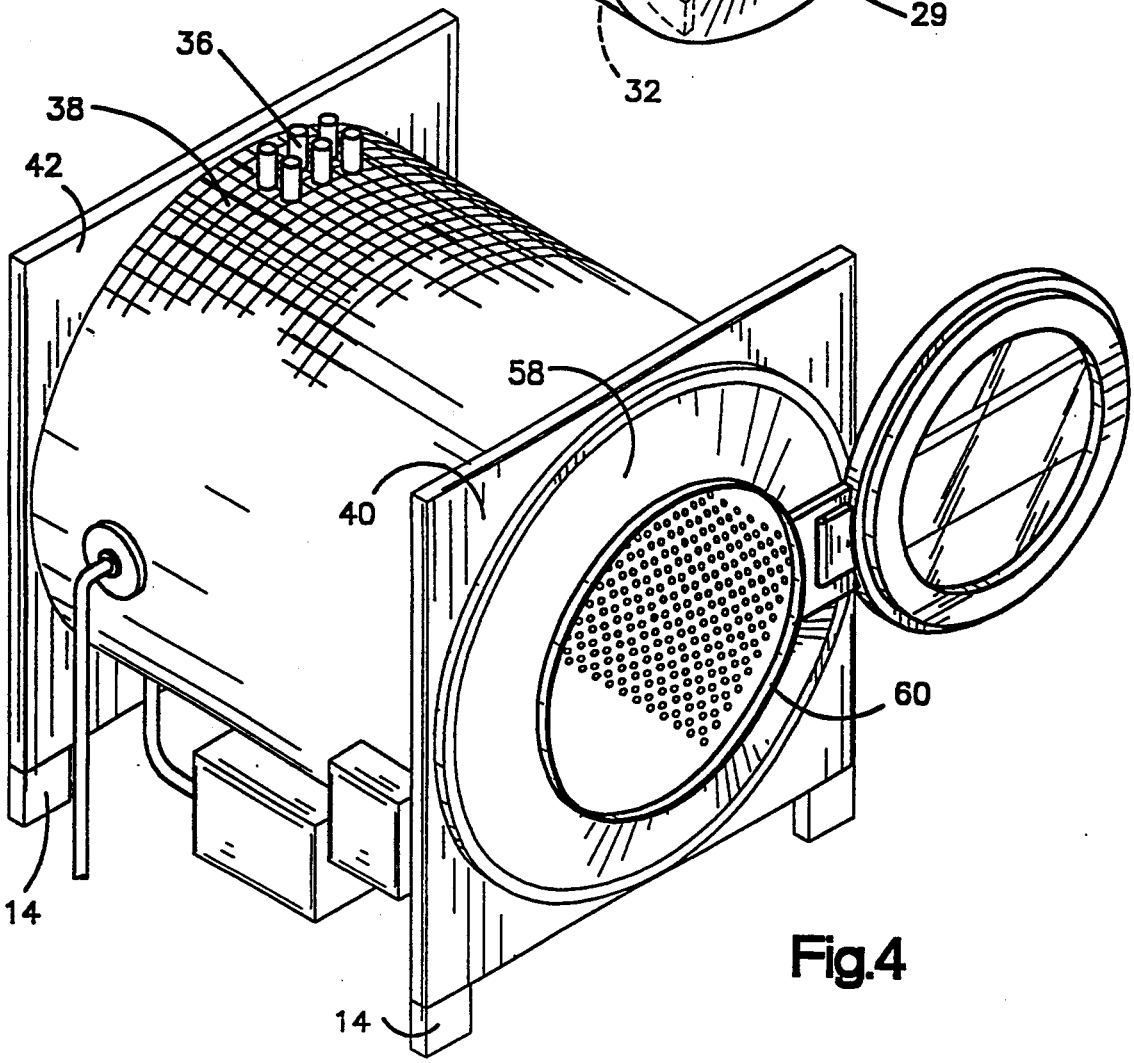
FIG. 4 is a perspective view of a partially assembled embodiment of the machine.

As best shown in FIG. 4, the shell outer surface 13 of shell 12 preferably is covered by a layer of insulation 38. The most preferred type of insulation is closed cell polyurethane foam insulation, which substantially reduces heat losses.

Figure 5:
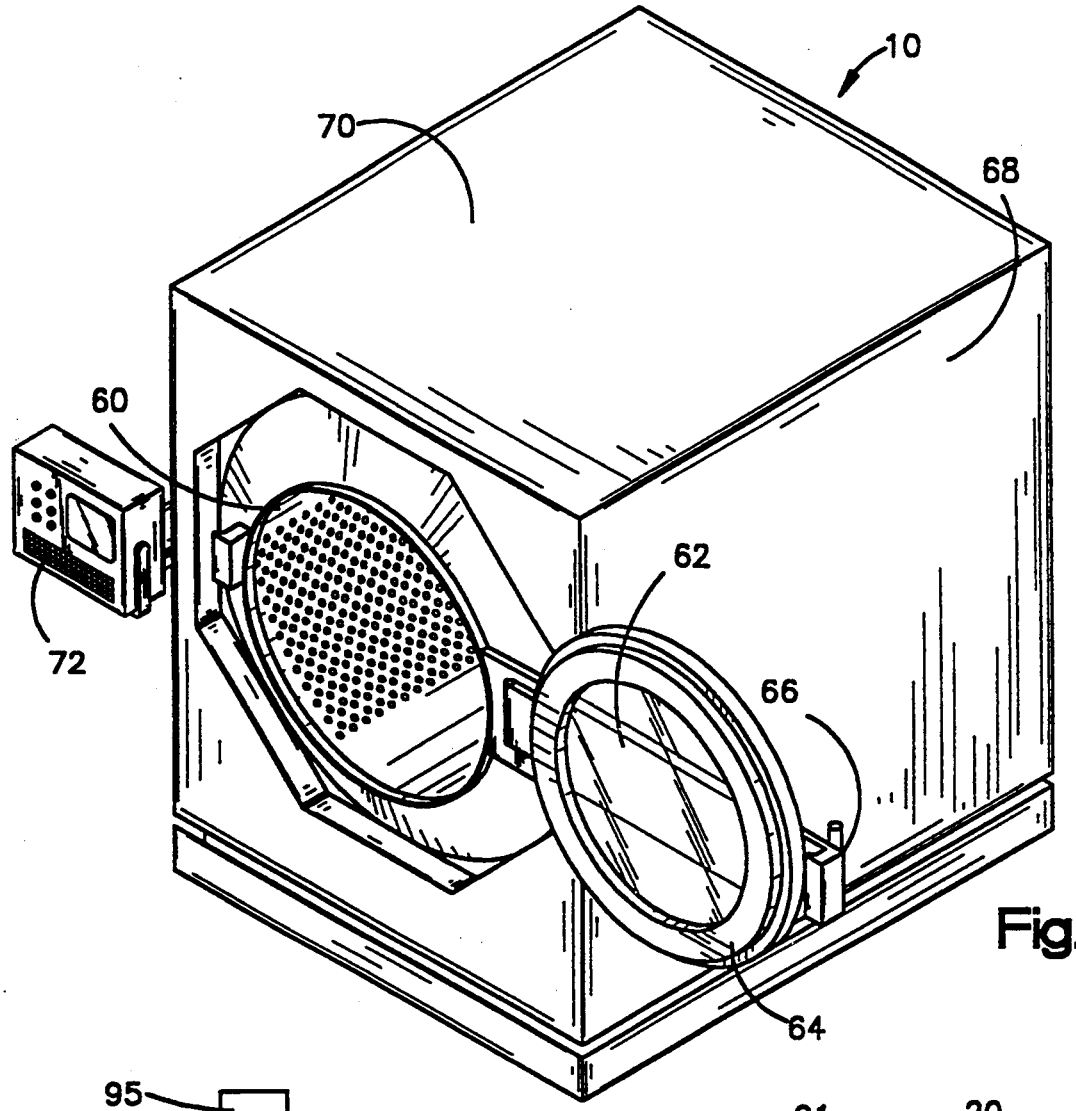
FIG. 5 is a perspective view of a finished, assembled textile treating machine, with its main access door open.

As shown in detail in FIGS. 4 and 5, shell 12 is mounted between and supported by end panels 40 and 42. The open end 15 of the outer shell 12 is covered and sealed by cylindrical shell end face panel 58, having flanged or other connection to the end 15 and having an access door 62 attached to the cylindrical shell end face panel 58 by hinges and having sealing means 64 and locking means 66. Enclosing cabinet 70 is formed by the combination of end panels 40 and 42 with a top panel and two side walls 68.

An electronic control panel 72, for controlling or presetting process parameters, such as bath temperature and pH, is accessibly mounted on the enclosing cabinet 70. The apparatus thus subject to control, such as pumps, sensors, and the like, may be conveniently mounted below the outer shell 12 and within enclosing cabinet 70, as generally shown in FIG. 4. Preferably, the system comprising the heat exchanger 20 should be connected via insulated piping to an insulated holding tank equipped with heating means, as a measure to conserve both water and energy.

Figure 6:
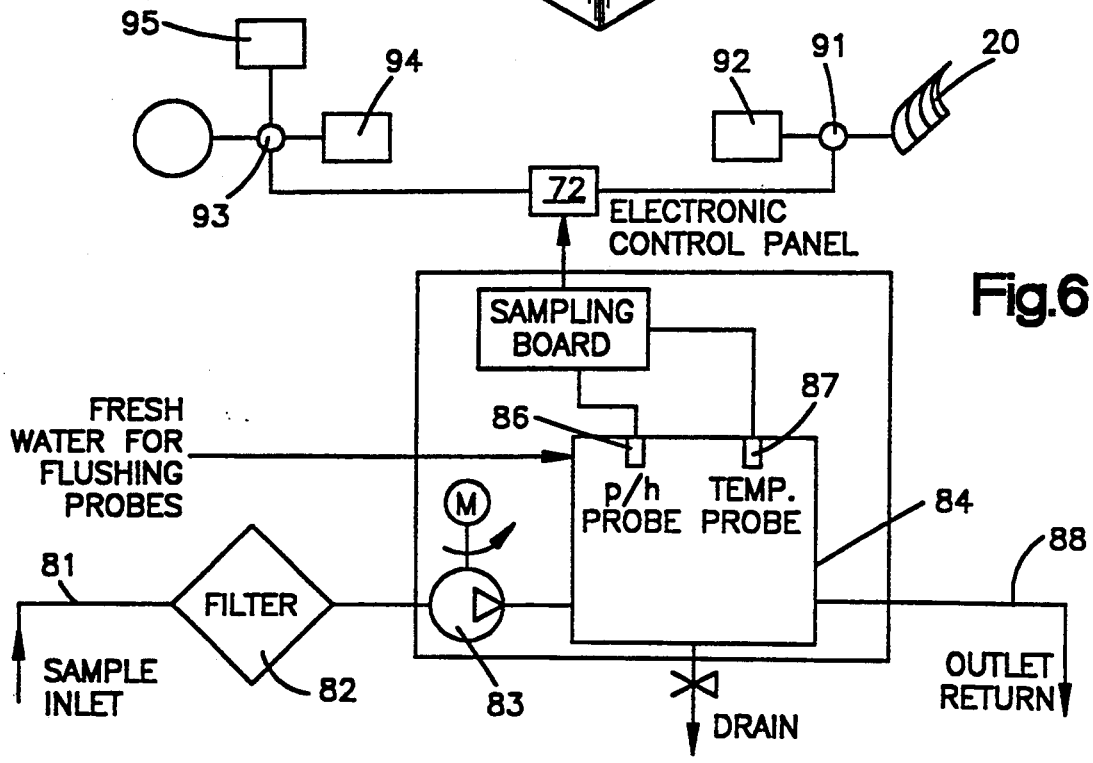
FIG. 6 is a schematic diagram of the automatic pH and temperature monitoring and control system.

FIG. 6 is a schematic diagram of the automatic monitoring and control system, for such process parameters as pH and temperature. As shown, a sample of the bath is withdrawn, via a connection 81 to the shell drain 22 or sump 24, passed through a filter 82 and pumped by a pump 83 into a sealed sensing chamber 84. FIG. 6 shows only probes for pH 86 and temperature 87, but other parameters may also be monitored and controlled. Following analysis, the sample is either discharged to drain or returned to the interior of the outer shell through the passage 88. The apparatus presently in use is either the Optima Elite or the Optima Prism (both manufactured by Softrol Systems, Inc., Acworth, Ga., and available from Washex Machinery Company, Wichita Falls, Tex.). Both are capable of analyzing and providing feedback information for a total of four parameters, for which automatic controls may also be provided if necessary. Samples may be obtained and analyzed continuously or as frequently as necessary. The signal thus obtained is transmitted to electronic control panel 72, which activates appropriate portions of the system in order to make necessary adjustments to the bath, or to alert the operator to make manual adjustments. The sensing chamber is further adapted to be flushed with clean water or with suitable standardizing reagents.

In the event the controls establish that the temperature of the bath has dropped below the desired temperature the control panel 72 initiates operation of a pump 91 which pumps heated water from a source of heated water 92 to the heat exchanger 20. Similarly if the controller has established that correction of the bath pH is required, the pump 93 operates to introduce acid or base from source 94 or 95 (respectively) to the shell 12.

Figure 7:
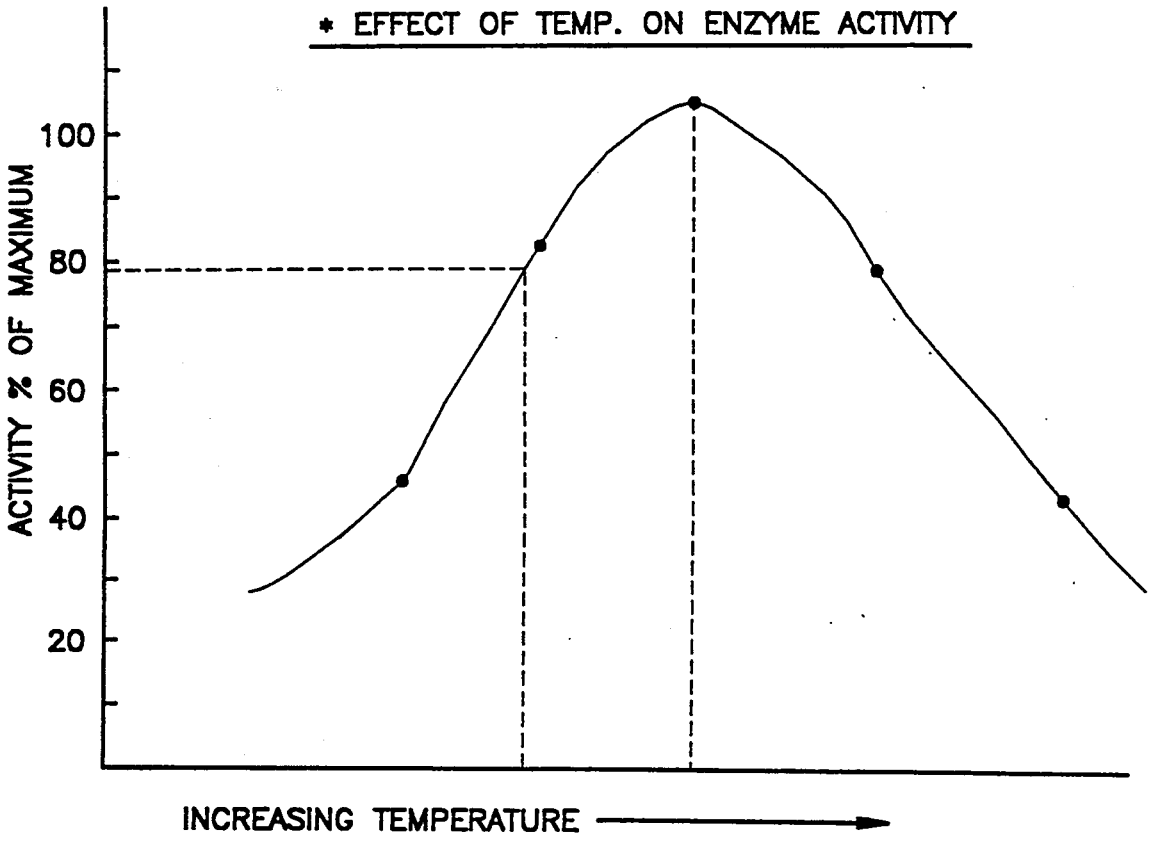
FIG. 7 is a graph of temperature against activity for a typical cellulase enzyme, showing the effect of temperature on enzymic activity.

FIG. 7 is a graphical plot illustrating the effect of temperature on enzyme activity for a typical cellulase enzyme. Enzyme activity plotted against treatment bath temperature reveals the substantial effect played by temperature on such activity. FIG. 7 shows that, a change of temperature, whether an increase or a decrease from an optimum value, causes a substantial decrease in enzyme activity.

In the illustrated embodiment of this process, the bath is comprised of an enzyme, preferably a cellulase enzyme, and more preferably an acid cellulase enzyme in a fluid such as water. The preferred embodiment further comprises the use of hot water as the heat source for adjusting the temperature of the bath, the hot water being passed through heat exchanger 20. The hot water is passed through the heat exchanger 20 in response to control signals generated at electronic control panel 72 from detector signals arising from the automatic pH and temperature monitoring and control system such as that diagrammed in FIG. 6.

The temperature of the hot water should preferably be no more than approximately 12° C. or 20° F. above the preselected temperature of the bath. The hot water at the preselected temperature is supplied from a source which includes a heat source capable of responding to control by the control system herein described. Such a low temperature differential is provided to avoid the denaturing the enzyme in the bath in the vicinity of the heat exchanger. If a hotter source of heat is used, denaturation of the enzyme in the vicinity of the heat exchanger may occur. The heat flux between the heat exchange medium and the enzyme bath is thus kept low, and avoids unnecessary thermal enzyme degradation.

The preselected, preferred temperature of use of the enzyme bath is in the range of 48°–66° C. This preselected temperature is preferentially controlled to within ±0.5° C. (equal to approximately ±1° F.) by the control system shown schematically in FIG. 6. If the temperature exceeds an upper limit temperature the enzyme will be denatured, and if the temperature is allowed to drop significantly below this preferred range, the enzyme becomes increasingly dormant as the temperature falls.

The preferred pH of an acid cellulase enzyme bath is approximately pH =4.8, and should preferably be maintained to within ±0.1 pH unit by the control system shown schematically in FIG. 6. The preferred pH of a neutral cellulase enzyme both is approximately pH=6–7. In both enzyme systems, excessive fluctuation in the pH value will result in denaturation or deactivation of the enzyme.

At least four types of enzymes are used in laundry applications, including stonewashing. Proteases, such as Esperase ® (available from Novo Nordisk) assist in the removal of protein-based stains, such as those from blood and various food products. Lipases, such as Lipolase TM (Novo Nordisk) are used to aid the removal of fat-containing stains such as from food and cosmetics. Amylases, such as Teramyl ® (Novo Nordisk) are used to remove residues of starchy foods such as mashed potatoes or porridge. Cellulases, such as Celluzyme ® (Novo Nordisk) are used for color brightening, fabric softening, stonewashing and removal of particulate soil. Other enzymes, particularly synthetic enzymes, are in used in the textile industry in relation to dyeing of fabrics.

In the stonewashing industry two types of enzymes are presently in use, acid cellulase and neutral cellulase enzymes. Acid cellulases are less expensive, and therefore preferable economically, but are more difficult to use effectively due to the narrow pH and temperature ranges in which they operate efficiently. Acid cellulase baths should be closely monitored to maintain, preferably, a maximum temperature range of approximately ±0.5° C. (±1° F.), and a maximum pH range of approximately ±0.1 pH unit.

Neutral cellulases are more operationally forgiving than acid cellulases, but they are approximately 40% more expensive.

Synthetic enzymes are very similar to the cellulase enzymes with respect to the degree of pH and temperature control required for processing as described herein.

The enzyme bath maintenance system described herein will control the precise temperature and pH requirements of the enzyme process. Temperature levels are maintained by indirect heating with internal plate coils or pipe coils. These coils may either be rigidly attached to the shell structure or be removable for easier service or maintenance. In the case of removable coils, the apparatus is capable of operation with one of the coils removed, which will eliminate downtime if repairs make a coil unavailable. The preferred heating medium is hot water.

The presently disclosed apparatus has been designed for and is preferably used with enzyme-based systems for treating textile materials. For instance, since enzymes have a high specific gravity and are generally not completely dissolved in an aqueous bath system, they sink or tend to settle out. The enzymes thus tend to collect or to become entrapped in the sump and other low or embedded locations or voids. To overcome this problem, the drum outer surface 27 has been equipped with vanes for agitating the enzymes and preventing their settlement or entrapment in such locations. As a second instance, due to the need of enzymes to be used in a thermally stable and controlled environment, the outer shell of the apparatus has been equipped with thermal insulation, specifically closed cell polyurethane insulation, in order to help maintain a steady, controlled temperature.

The invention has been described hereinabove with particular reference to achieving, in textile materials, a stonewashed effect by the use of an enzyme bath, in particular the use of cellulase enzymes on denim-type fabrics. It is to be understood, however, that reference to stonewashing of denim-type fabrics is not to be construed as an indication that the broader aspects of the invention are so limited, but that the disclosure is intended to include other fabrics, and further to include other processes such as cleaning, laundering, and dyeing of such fabrics, with or without the use of enzymes. The apparatus and method herein described and claimed further are applicable to and are specifically intended to include tunnel-type machines for the treatment of textile materials.

What is claimed is:

1. A method of treating textiles with enzymes having a predetermined narrow temperature range of effectiveness and an upper temperature limit above which the enzyme is denatured comprising:

producing a bath containing said enzyme at a temperature within said predetermined range, treating textiles in said bath, providing a heat exchanger with a surface in contact with said bath while said bath is in contact with the textiles, and operating said heat exchanger so that the temperature of said surface does not exceed said temperature limit while said heat exchanger compensates for heat loss to the environment and maintains said bath within said temperature range, and continuously agitating said bath at a sufficient rate to maintain the distribution of said enzymes in a substantially uniform manner throughout said bath, and to maintain the entire bath at a substantially uniform temperature.

2. A method as set forth in claim 1, wherein insulation is provided to limit the loss of heat from said bath to said environment.

3. A method as set forth in claim 1, including producing a container to contain said bath, constructing said container to avoid zones in which said enzyme can collect.

4. A method as set forth in claim 1, wherein said enzyme is a cellulase enzyme.

5. A method as set forth in claim 1, wherein said enzyme is an acid cellulase enzyme.

6. A method as set forth in claim 1, further comprising providing means for measuring and controlling the pH of said bath, and providing means for addition of materials for adjusting said pH without causing denaturation or deactivation of said enzyme.

7. A method as set forth in claim 6, wherein said pH of the bath is maintained within about 0.5 pH units of a preferred pH.

8. A method as set forth in claim 1, wherein said heat exchanger maintains the temperature within about 0.5° C. of a preferred temperature.

* * * * *

UNITED STATES PATENT AND TRADEMARK OFFICE

CERTIFICATE OF CORRECTION

PATENT NO. : 5,333,338

DATED : August 2, 1994

INVENTOR(S) : Constantin Anastase et al.

It is certified that error appears in the above-identified patent and that said Letters Patent is hereby corrected as shown below:

Column 2, line 33, after "stonewashed" delete "obtained".

Column 2, line 34, after "results" insert --obtained--.

Column 3, line 29, after "shell" insert --12--.

Column 3, line 31, delete "to" and insert --within--.

Column 3, line 33, after "element" insert --20--.

Column 5, line 65, after "avoid" delete "the".

Column 6, line 18, delete "both" and insert --bath--.

Signed and Sealed this

Thirteenth Day of December, 1994

Bruce Lehman

*Attest:*

BRUCE LEHMAN

*Attesting Officer*

*Commissioner of Patents and Trademarks*